US010825631B2

(12) United States Patent
Priest

(10) Patent No.: US 10,825,631 B2
(45) Date of Patent: Nov. 3, 2020

(54) SOLENOID ASSEMBLY WITH DECREASED RELEASE TIME

(71) Applicant: TE CONNECTIVITY CORPORATION, Berwyn, PA (US)

(72) Inventor: Marcus Priest, Carpinteria, CA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 239 days.

(21) Appl. No.: 16/042,266

(22) Filed: Jul. 23, 2018

(65) Prior Publication Data

US 2020/0027675 A1 Jan. 23, 2020

(51) Int. Cl.

*H01H 50/18* (2006.01)
*H01H 50/54* (2006.01)
*H01H 50/56* (2006.01)

(52) U.S. Cl.

CPC ..... *H01H 50/18* (2013.01); *H01H 50/546* (2013.01); *H01H 50/56* (2013.01); *H01H 2235/01* (2013.01)

(58) Field of Classification Search

CPC ..... H01H 50/18; H01H 50/546; H01H 50/56; H01H 2235/01

See application file for complete search history.

(56) References Cited

U.S. PATENT DOCUMENTS 2,539,547 A 1/1951 Mossman et al.
4,290,039 A 9/1981 Tochizawa
4,409,580 A 10/1983 Ishigaki
9,324,488 B2 * 4/2016 Dayton ..... H01F 7/081
10,319,549 B2 * 6/2019 Wardle ..... H01H 45/04
2008/0122562 A1 * 5/2008 Bush ..... H01H 51/2209 335/153
2008/0245983 A1 * 10/2008 Hoppe ..... H01F 7/1607 251/65
2011/0204269 A1 * 8/2011 Hoppe ..... F16K 31/061 251/129.01
2016/0079017 A1 3/2016 Priest
2017/0271115 A1 * 9/2017 Wardle ..... H01H 51/06
2018/0158635 A1 * 6/2018 Tashima ..... H01H 50/54

OTHER PUBLICATIONS

International Search Report, International Application No. PCT/IB2019/056256, International Filing Date, Jul. 22, 2019.

* cited by examiner

*Primary Examiner* — Mohamad A Musleh

(57) ABSTRACT

A solenoid assembly includes the solenoid armature assembly having a flux tube or magnetic bearing having an opposed first end and a second end. The armature assembly additionally includes an armature having an opposed third end and a fourth end and movable within the flux tube or magnetic bearing along a mutual axis. The fourth end of the armature is slidably movable beyond the second end of the flux tube or magnetic bearing. A top plate facing the fourth end of the armature, the top plate having an opening for slidably receiving the central core. A slot is included in at least one of the flux tube or magnetic bearing, the armature, and the top plate to improve or decrease release time between the movable contacts and the stationary contacts.

18 Claims, 2 Drawing Sheets

SOLENOID ASSEMBLY WITH DECREASED RELEASE TIME

FIELD OF THE INVENTION

The present invention is directed to solenoid assemblies. More particularly, the present invention is directed to solenoid assemblies having solenoid armature assemblies which provide improved or decreased release times between contacts.

BACKGROUND OF THE INVENTION

Solenoids are frequently employed in electronic circuits to provide rapid switching. Conventional solenoids exhibit a release time on the order of about 3 to 4 milliseconds. The eddy currents generated during switching limit the solenoids ability to overcome overtravel rapidly.

It would be beneficial to provide a solenoid which allows for improved or decreased release time between the movable contacts and the stationary contacts.

BRIEF DESCRIPTION OF THE INVENTION

In an embodiment, a solenoid armature assembly including a flux tube or magnetic bearing having an opposed first end and a second end. The armature assembly additionally includes an armature having an opposed third end and a fourth end and movable within the flux tube or magnetic bearing along a mutual axis. The fourth end of the armature is slidably movable beyond the second end of the flux tube or magnetic bearing. A top plate facing the fourth end of the armature, the top plate having an opening for slidably receiving the central core. A slot is included in at least one of the flux tube or magnetic bearing (extending between the first end and the second end), the armature (extending between the third end and the fourth end), and opposed surfaces of the top plate (extending from the opening toward an edge).

In another embodiment, a solenoid assembly including the solenoid armature assembly having a flux tube or magnetic bearing having an opposed first end and a second end. The armature assembly additionally includes an armature having an opposed third end and a fourth end and movable within the flux tube or magnetic bearing along a mutual axis. The fourth end of the armature is slidably movable beyond the second end of the flux tube or magnetic bearing. A top plate facing the fourth end of the armature, the top plate having an opening for slidably receiving the central core. A slot is included in at least one of the flux tube or magnetic bearing (extending between the first end and the second end), the armature (extending between the third end and the fourth end), and opposed surfaces of the top plate (extending from the opening toward an edge).

Other features and advantages of the present invention will be apparent from the following more detailed description, taken in conjunction with the accompanying drawings which illustrate, by way of example, the principles of the invention.

BRIEF DESCRIPTION OF THE DRAWINGS

Wherever possible, the same reference numbers will be used throughout the drawings to represent the same parts.

DETAILED DESCRIPTION OF THE INVENTION

Provided is a solenoid switch. Embodiments of the present disclosure, for example, in comparison to concepts failing to include one or more features disclosed herein, provide for the rapid release a solenoid switch. The switch exhibits reduced eddy currents and provides a shorter release time.

Figure 1:
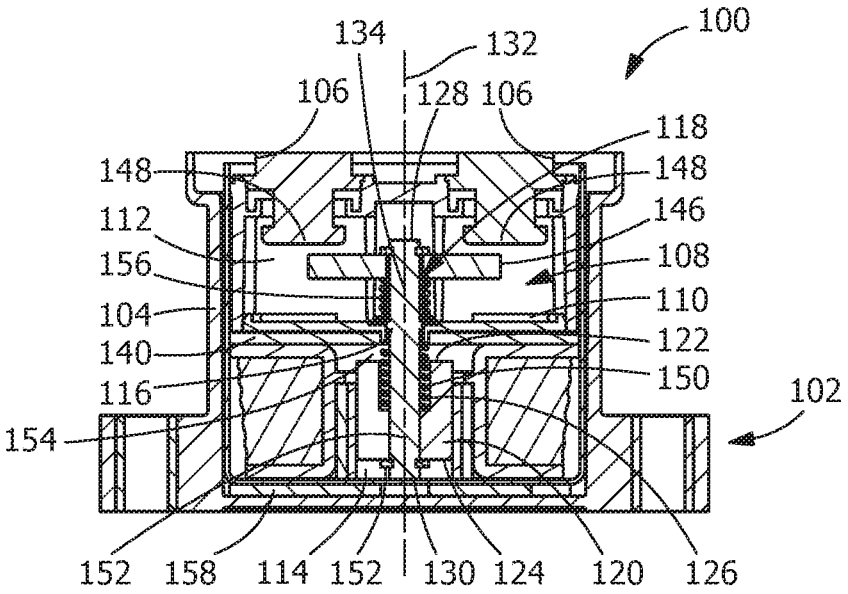
FIG. 1 is a perspective view of a solenoid, according to an embodiment, shown in the open position.
Figure 2:
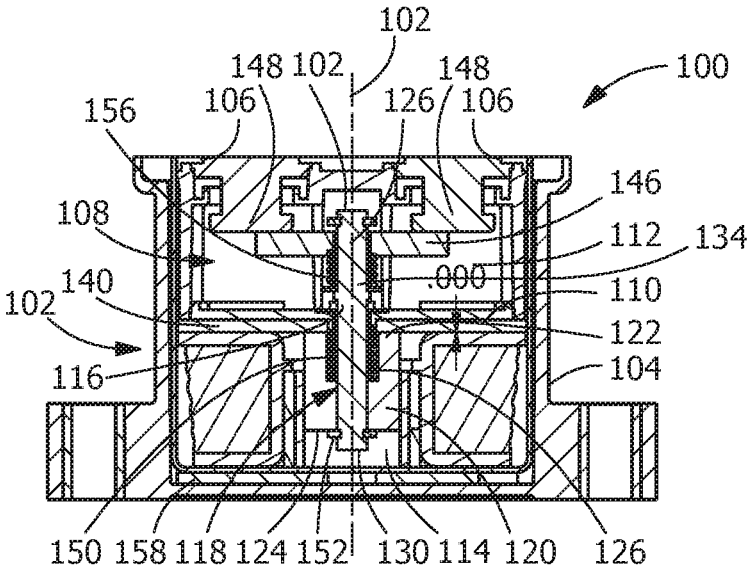
FIG. 2 is a perspective view of a solenoid, according to an embodiment, shown in the closed position.

An embodiment of a solenoid assembly 100 is shown in FIGS. 1 and 2. The solenoid assembly 100 includes housing 102 having a housing wall 104 including at least one aperture 106 extending through the housing wall 104. The housing wall 104 further defines a cavity 108. A partition 110 is positioned in the cavity 108 and defines at least two regions 112, 114 within the cavity 108. The partition 110 further includes a partition aperture 116 positioned to allow communication between the at least two regions 112, 114.

The solenoid assembly 100 further includes an armature assembly 118 positioned within the cavity 108. The armature assembly 118 includes a flux tube or magnetic bearing 120 having an opposed first end 122 and a second end 124. The armature assembly 118 further includes an armature 126 having an opposed third end 128 and a fourth end 130. The armature 126 is slidably movable within the flux tube or magnetic bearing 120 and relative to a central core 134 along a mutual axis 132. The fourth end 130 of the armature 126 is slidably movable beyond the second end 124 of the flux tube or magnetic bearing 120. A top core plate 140 is positioned proximate the armature 126 and faces the fourth end 130 of the armature 126. The top core plate 140 has an opening 142 (best shown in FIG. 3) for slidably receiving the armature 126. In some embodiments, the top core plate 140 is adjacent to a face of the partition 110. In some embodiments, the top core plate 140 may be coextensive with the partition 110.

The armature assembly 118 is slidably positioned within the solenoid assembly 100. The armature 126 slidably extends through the partition aperture 116 into both of the at least two regions 112, 114. A movable electrical contact 146 is attached to the armature 126 and is configured to be in selective communication with one or more fixed electrical contacts 148 such that the central core 134 may be selectively positioned to allow communication between the electrical contact 146 and the fixed electrical contacts 148. The fixed electrical contacts 148 may be further configured to selectively communicate with an external circuit (not shown) via the at least one aperture 106.

The armature assembly 118 further includes an armature spring 150 positioned in the region 114. The armature spring 150 is attached to both the partition 110 and armature assembly 118. The armature spring 150 is configured to apply an armature spring force to the armature assembly 118. The armature spring force is directed against both the partition 110 and armature assembly 118 in order to move the armature assembly 118 to a retracted position when the coil current is small. The armature spring force may cause the armature assembly 118 to slidably at least partially retract through the partition aperture 116 which may selectively position the armature assembly 118 such that the electrical contact 146 and fixed electrical contact 148 will not be in communication. A retaining clip 152 is added to an end of the central core 134 to transfer an impact between the armature assembly 118 and the housing wall 104 during movement of the armature assembly 118, in order to allow for an increased parting force and velocity. In some embodiments, an air gap 154 between the armature assembly 118 and the partition 110 is maintained, allowing the magnetic force present on the armature assembly 118 to be directly coupled to the electrical contact 146.

The armature assembly 118 may optionally further include a contact spring 156 positioned in the region 112. The contact spring 156 may be configured to apply a contact spring force to the armature assembly 118. The contact spring force may be directed against both the partition 110 and armature assembly 118 in order to move the armature assembly 118 to an extended position. The contact spring force may cause the armature assembly 118 to slidably at least partially extend through the partition aperture 116 which may selectively position the armature assembly 118 such that the electrical contact 146 and fixed electrical contact 148 will be in communication.

An optional bottom core plate 158 may be positioned opposite the top core plate 140 to act as a core doubler. The bottom plate 158 faces the third end 128 of the armature 126 and has an opening 162 for slidably receiving the armature 126. In some embodiments, the bottom core plate 158 may be adjacent to the housing wall 104. In one embodiment, the bottom core plate 158 may be coextensive with the housing wall 104.

The solenoid assembly 100 further includes an electrically conductive coil 160 positioned within the housing 102 and configured to apply a magnetic force to the armature assembly 118 in response to a coil current within the electrically conductive coil 160. The magnetic force may be in opposition to the armature spring force acting on the armature assembly 118. The magnetic force may cause the armature assembly 118 to slidably at least partially extend through the partition aperture 116, which may selectively position the armature assembly 118 such that the electrical contact 146 and fixed electrical contact 148 will be in communication. The rapidity of the mechanical movement of the armature assembly 118, in response to the magnetic force, determines how quickly the solenoid assembly 100 will respond to the application of the coil current. A typical activation response time for a solenoid is about $5\times10^{-2}$ to $2\times10^{-4}$ seconds.

Figure 3:
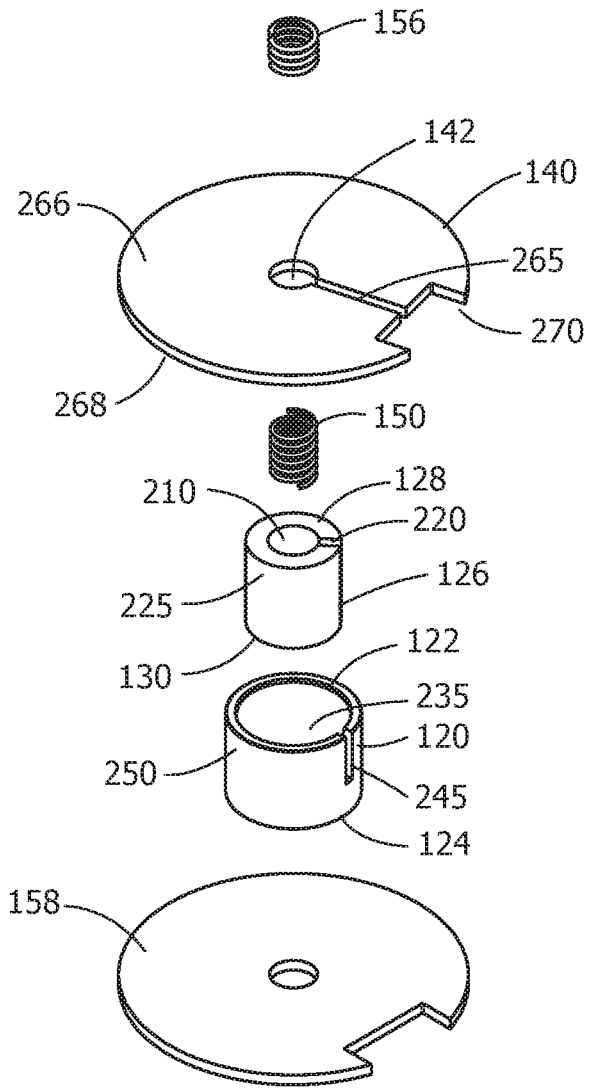
FIG. 3 is an exploded view of a solenoid armature, according to an embodiment.

FIG. 3 presents an exploded view of the armature assembly 118. In the example of FIG. 2, the armature assembly 118 includes the armature 126 having a central axial opening 210 extending a length of the armature 126. In some embodiments the central axial opening 210 exhibits a circular cross section. The armature 126 may additionally include an armature slot 220 extending radially from the central axial opening 210 to an outer surface 225 of the armature 126. In some embodiments, the armature slot 220 extends the length of the armature 126. In some embodiments, the armature slot 220 may be a through slot.

The armature assembly 118 additionally includes the flux tube or magnetic bearing 120 having a central axial opening 235 extending a length of the flux tube or magnetic bearing 120. In some embodiments the central axial opening 235 exhibits a circular cross section. The flux tube or magnetic bearing 120 may additionally include a flux tube slot 245 extending radially from the central axial opening 235 to an outer surface 250 of the flux tube or magnetic bearing 120. In some embodiments, the flux tube slot 245 may be a through slot. In some embodiments, the flux tube slot 245 extends the length of the flux tube or magnetic bearing 120. The flux tube or magnetic bearing 120 may be configured to receive the armature 126 within the central axial opening 235. The armature 126 may be slidably positioned within the central axial opening 235 of the flux tube or magnetic bearing 120.

The top core plate 140 may include a top core plate slot 265 extending radially from the opening 142 to an outer surface or edge 270 of the top core plate 140. The top core plate slot 265 extends between opposed surfaces 266, 268 of the top core plate 140. In some embodiments, the top core plate slot 265 may be a through slot.

The dimensions and configurations of the slots may vary. In various embodiments, the slots have a width which may be consistent with or equal to the thickness of the particular armature, flux tube or top core plate in which the slot is positioned. In various embodiments, the slots may be parallel to the longitudinal axis of the armature assembly or may not be parallel to the longitudinal axis of the armature assembly. In various embodiments, the slots may be straight or may be curved.

Many factors can contribute to the release time including spring forces, spring response time, residual (eddy) currents, contact overtravel, and the mass of magnetic material. Without being bound to a particular theory, it is believed that the inclusion of a slot in one or more of the components of the armature assembly 118 reduces the release time of the solenoid assembly 100 by providing a discontinuity in the flow path of the eddy currents resulting from de-powering the solenoid assembly 100.

If one or more of the components (the armature 126, the flux tube or magnetic bearing 120 and/or the top core plate 140) has a slot provided therein, the slots of the components may be aligned. Alternatively, the slots may not be aligned with each other.

In one illustrative embodiment, the armature assembly 118 has a slot formed in at least two of the flux tube or magnetic bearing 120 (extending between the first end 122 and the second end 124), the armature 126 (extending between the third end 128 and the fourth end 130), and the top plate 140 (extending from the opening 142 toward the edge 270). The slots may be formed or positioned in-line, not aligned or randomly.

In another illustrative embodiment, the armature assembly 118 has a slot formed in at each of the flux tube or magnetic bearing 120 (extending between the first end 122 and the second end 124), the armature 126 (extending between the third end 128 and the fourth end 130), and the top plate 140 (extending from the opening 142 toward the edge 270). The slots may be formed or positioned in-line, randomly, within an angle of 15 degrees or less, within an angle of 5 degrees or less, or at other angles.

In the example of the FIG. 2, the armature assembly 118 includes the armature spring 150 having a spring rate of greater than 2 pounds per inch. In some embodiments, the spring rate of the armature spring 150 and/or the contact spring 156 may be increased to provide an increased separation force to the armature 126. In some embodiments, the armature spring 150 exhibits a high spring rate greater than 100 pounds per inch (for example, but not limited to approximately 300 pounds per inch) allowing for increased force and thus more rapid response during de-powering of the solenoid assembly 100. The high spring rate armature spring 150 may be used alone or in combination with the slotted armature materials to reduce the release time of the solenoid assembly 100.

EXAMPLES

The armature assembly operates in the linear region of the magnetic operating curve of the material (below saturation).

TABLE 1

| Core Top | Core Bottom | Flux Tube | Armature | Spring Rate | Release Time (milliseconds) |
|---|---|---|---|---|---|
| slot | no | no slot | no slot | low | 2.13 |
| slot | yes | slot | no slot | low | 2.69 |
| no slot | yes | slot | slot | low | 2.83 |
| no slot | yes | no slot | no slot | low | 3.39 |
| no slot | no | no slot | slot | low | 2.21 |
| slot | no | slot | no slot | high | 1.63 |
| slot | yes | slot | slot | high | 1.90 |
| no slot | no | slot | slot | high | 1.57 |
| slot | no | slot | slot | low | 2.07 |
| slot | yes | no slot | no slot | high | 2.04 |
| slot | no | no slot | slot | high | 1.48 |
| no slot | yes | slot | no slot | high | 2.63 |
| no slot | no | slot | no slot | low | 2.78 |
| slot | yes | no slot | slot | low | 2.69 |
| no slot | no | no slot | no slot | high | 1.75 |
| no slot | yes | no slot | slot | high | 1.98 |

A typical de-activation release time of a conventional solenoid is greater than about 3 milliseconds. As shown in the above results, the inclusion of one or more slotted components in the armature assembly 118 results in decreased release times while still allowing full contact overtravel and full contact force, thereby insuring that a positive electrical connection is affected when the movable contact is moved into engagement with the stationary contact. Additionally, as shown in the above results, the inclusion of the armature spring 150 having a high spring rate alone or in combination with one or more slotted components results in decreased release times. In some embodiments, the release time is less than 2 milliseconds.

While the invention has been described with reference to one or more embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims. In addition, all numerical values identified in the detailed description shall be interpreted as though the precise and approximate values are both expressly identified.

What is claimed is:

1. A solenoid armature assembly comprising:

a flux tube having an opposed first end and a second end;

an armature having an opposed third end and a fourth end and movable within the flux tube along a mutual axis; the fourth end of the armature slidably movable beyond the second end of the flux tube; and a top plate facing the fourth end of the armature, the top plate having an opening for slidably receiving the central core;

wherein a slot is formed in at least two of the flux tube (extending between the first end and the second end), the armature (extending between the third end and the fourth end), and opposed surfaces of the top plate (extending from the opening toward an edge).

2. The solenoid armature assembly of claim 1, wherein the slot is a through slot.

3. The solenoid armature assembly of claim 1, wherein a slot is formed in at least two of the flux tube (extending between the first end and the second end), the armature (extending between the third end and the fourth end), and opposed surfaces of the top plate (extending from the opening toward an edge).

4. The solenoid armature assembly of claim 3, wherein a slot is formed in each of the flux tube (extending between the first end and the second end), the armature (extending between the third end and the fourth end), and opposed surfaces of the top plate (extending from the opening toward an edge).

5. The solenoid armature assembly of claim 3, wherein the slots are not aligned.

6. The solenoid armature assembly of claim 1, further comprising an armature spring having a spring rate of greater than 2 pounds per inch.

7. The solenoid armature assembly of claim 6, further comprising a contact spring having a spring rate of greater than 100 pounds per inch.

8. The solenoid armature assembly of claim 1, wherein the slot which is formed in at least one of the flux tube, the armature, and the slot has a width equal to the thickness of the armature, flux tube or top plate in which the slot is positioned.

9. The solenoid armature assembly of claim 1 further comprising a bottom plate facing the third end of the armature, the bottom plate having an opening for slidably receiving the central core.

10. A solenoid assembly comprising:

an armature assembly comprising:

a central core;

a flux tube;

an armature movable within the flux tube; and a top plate proximate the armature, the top plate having a first opening for slidably receiving the central core;

a bottom plate, the bottom plate having a second opening for slidably receiving the central core of the armature assembly;

wherein a slot is formed in at least one of the flux tube, the armature, and opposed surfaces of the top plate.

11. The solenoid assembly of claim 10, wherein the solenoid assembly exhibits a deactivation release time of less than 2 milliseconds.

12. The solenoid assembly of claim 10, wherein the slot is a through slot.

13. The solenoid assembly of claim 10, wherein a slot is formed in at least two of the flux tube, the armature, and opposed surfaces of the top plate.

14. The solenoid assembly of claim 13, further comprising a contact spring having a spring rate of greater than 100 pounds per inch.

15. The solenoid assembly of claim 13, wherein the slots are not aligned.

16. The solenoid assembly of claim 10, wherein a slot is formed in each of the flux tube, the armature, and opposed surfaces of the top plate.

17. The solenoid assembly of claim 10, further comprising an armature spring having a spring rate of greater than 2 pounds per inch.

18. The solenoid assembly of claim 10, wherein the slot which is formed in at least one of the flux tube, the armature, and the slot has a width equal to the thickness of the armature, flux tube or top plate in which the slot is positioned.

* * * * *